United States Patent [19]

Goodwin, Jr. et al.

[11] Patent Number: 4,743,724

[45] Date of Patent: May 10, 1988

[54] WALL SWITCH EXTENSION OPERATOR

[76] Inventors: Robert S. Goodwin, Jr., P.O. Box 1129, Meridian, Miss. 39301; George Spector, 233 Broadway, Rm 3815, New York, N.Y. 10007

[21] Appl. No.: 929,080

[22] Filed: Nov. 10, 1986

[51] Int. Cl.[4] ..... H01H 17/02

[52] U.S. Cl. ..... 200/331; 200/153 F; 200/161

[58] Field of Search ..... 200/331, 330, 332, 161, 200/153 F, 337

[56] References Cited

U.S. PATENT DOCUMENTS

| | | | |
|---|---|---|---|
| 2,461,614 | 2/1949 | Seaman | 200/331 |
| 2,466,820 | 4/1949 | Oberschmidt | 200/331 |
| 2,760,035 | 8/1956 | Friesen | 200/331 |
| 3,581,037 | 5/1971 | Schiffelbein | 200/331 |
| 3,827,039 | 7/1974 | Agnese | 200/153 F X |
| 3,839,615 | 10/1974 | Bradford | 200/331 |
| 3,916,134 | 10/1975 | Hansen | 200/331 |
| 4,221,946 | 9/1980 | Halstrom | 200/331 |
| 4,295,026 | 10/1981 | Williams et al. | 200/331 |

FOREIGN PATENT DOCUMENTS

| | | | |
|---|---|---|---|
| 968835 | 6/1975 | Canada | 200/330 |

*Primary Examiner*—Henry J. Recla
*Assistant Examiner*—Ernest G. Cusick

[57] ABSTRACT

An extension control apparatus for a wall switch mounted within a wall. The wall switch has a moveable lever extending through the cover plate. The apparatus consists of a housing secured to the cover plate, an elongated vertical rod connected to a cap placed over end of the lever extending through the housing and a pair of stoppers affixed to the rod on either side of a guide member mounted to the wall to limit travel of the rod when the rod is manually operated up and down to activate the lever of the wall switch.

1 Claim, 1 Drawing Sheet

WALL SWITCH EXTENSION OPERATOR

BACKGROUND OF THE INVENTION

The instant invention relates generally to remote operating devices for wall switches and more specifically it relates to an extension control apparatus for a wall switch.

Numerous remote operating devices have been provided in prior art that are adapted to move the levers of wall switches up and down by dependent structures. For example, U.S. Pat. Nos. 2,760,035; 3,916,134 and 4,295,026 all are illustrative of such prior art. While these units may be suitable for the particular purpose to which they address, they would not be as suitable for the purposes of the present invention as heretofore described.

SUMMARY OF THE INVENTION

A primary object of the present invention is to provide an extension control apparatus for a wall switch that will overcome the shortcomings of the prior art devices.

Another object is to provide an extension control apparatus for a wall switch that can be installed without hindering the wall switch functions.

An additional object is to provide an extension control apparatus for a wall switch that is designed to assist the handicapped, short people and children to turn on and off a room light.

A further object is to provide an extension control apparatus for a wall switch that is simple and easy to use.

A still further object is to provide an extension control apparatus for a wall switch that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
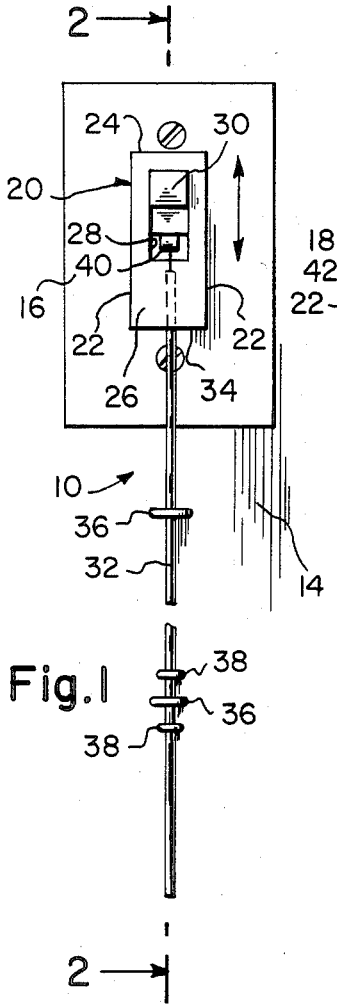
FIG. 1 is a front view of the invention.
Figure 2:
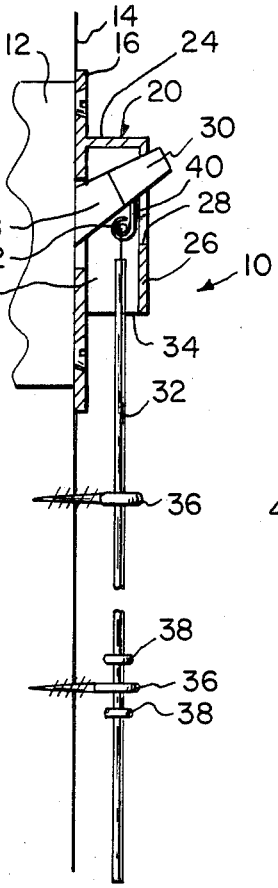
FIG. 2 is a cross sectional view taken along line 2—2 in FIG. 1.

Turning now descriptively to the drawings, in which similar reference characters denote similar elements throughout the several views, FIGS. 1 and 2 illustrate an extension control apparatus 10 for a wall switch 12 mounted within a wall 14. The wall switch has a cover plate 16 attached thereto and a moveable lever 18 extending through the cover plate. The apparatus 10 consists of a housing 20 secured to the cover plate 16. The housing includes a pair of side walls 22, a upper wall 24 and a front wall 26 that has an aperture 28 therein through which the lever 18 of the wall switch 12 extends. A cap 30 is placed over end of the lever 18 in which an elongated rod 32 has a top end pivotly connected to underside of the cap 30 and extends downwardly therefrom through open bottom 34 of the housing 20. Guide members 36 are mounted to the wall 14 with the rod 32 extending therethrough. A pair of stoppers 38 are affixed to the rod 32 on either side of one of the guide members 36 to limit travel of the rod when the rod is manually operated up and down to activate the lever 18 of the wall switch 12.

A hook member 40 is connected to the underside of the cap 30 while a ball member 42 is connected to the top end of the rod 32 to ride within the hook member 40 so that the rod can be pivotly connected thereto.

Figure 3:
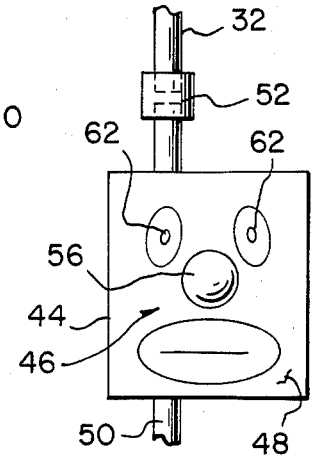
FIG. 3 is a front view of a control box with a face thereon connected to the bottom of the rod to operate the switch lever above.
Figure 4:
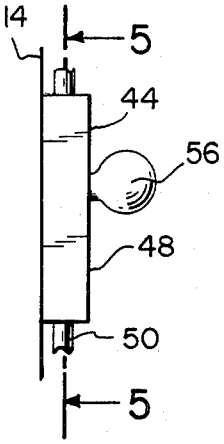
FIG. 4 is a side view thereof.
Figure 5:
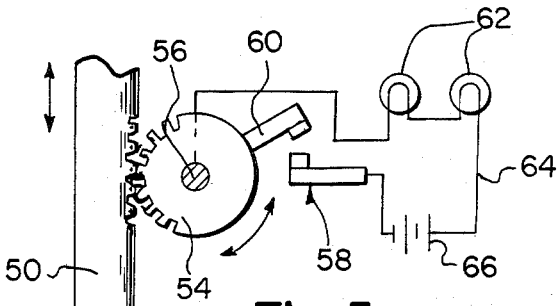
FIG. 5 is a cross sectional view with parts broken away taken along line 5—5 in FIG. 4, showing some of the internal parts schematically whereby the hose knob operates the rack arm to turn the wall switch on and off and also turn the LED eyes of the face on and off.

FIGS. 3, 4 and 5 show a control box 44 mounted to the wall 14 and affixed to lower end of the rod 32. The control box 44 includes a face 46 printed upon front surface 48 of the control box. A rack arm 50 extends vertically through the control box 44. An adapter sleeve 52 is provided for connecting top end of the rack arm 50 to the lower end of the rod 32. A pinion gear 54 has a knob 56 extending through the front surface 48 of the control box 44 to represent a nose of the face 46. The pinion gear 54 is in engagement with the rack arm 50 whereby turning of the knob 56 will manually operate the rod 32.

The control box 44 further includes an electrical switch 58 that has one contact arm 60 connected to the pinion gear 54. A pair of lamps 62 representing eyes of the face 46 are connected in a circuit 64 to the electrical switch 58 while a battery 66 is also connected in the circuit 64 to power the lamps 62 when the knob 56 is turned, turning off the wall switch 12.

Figure 6:
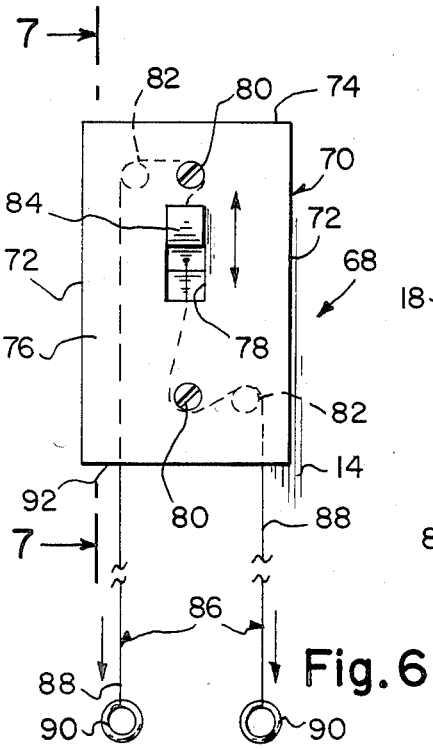
FIG. 6 is a modification in which a pair of strings instead of the rod operates the wall switch lever.
Figure 7:
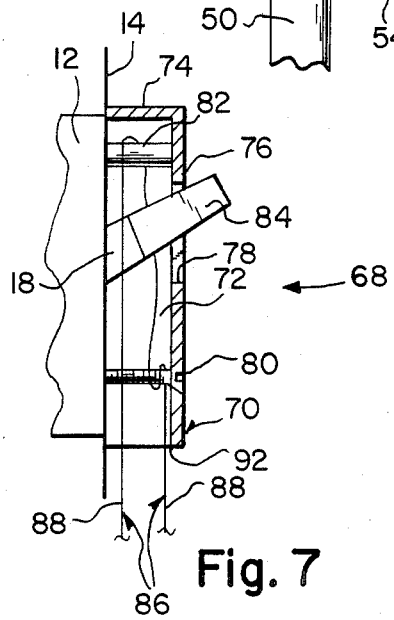
FIG. 7 is a cross sectional view taken along line 7—7 in FIG. 6 showing one of the internal guides and mounting screws to support the strings therein.

FIGS. 6 and 7 show a modified extension control apparatus 68 for wall switch 12 mounted within wall 14. The wall switch 12 has moveable lever 18 extending outwardly therefrom. The apparatus 68 consists of a housing 70 including a pair of side walls 72, an upper wall 74 and a front wall 76 that has an aperture 78 therein through which the lever 18 of the wall switch 12 extends. A pair of mounting screws 80 are for securing the housing 70 to the wall switch 12. A pair of guide posts 82 are provided. One of the guide posts 82 is mounted within the housing 70 parallel and to one side of one of the mounting screws 80 while other of the guide posts 82 is mounted within the housing 70 parallel and to opposite side of other of the mounting screws 80. A cap 84 is placed over end of the lever 18 with a mechanism 86 connected to the cap for selectively moving the lever 18 upwardly and downwardly to operate the wall switch 12. The selectively moving mechanism 86 includes a pair of cords 88 each having a pull ring 90 at bottom end thereof. One of the cords 88 is connected to top of the cap 84 around the upper mounting screw 80, the upper guide post 82 and downwardly therefrom through open bottom 92 of the housing 70. The other cord 88 is connected to bottom of the cap 84 around the lower mounting screw 80 and lower guide post 82 and downwardly therefrom through open bottom 92 of the housing 12. When upper cord 88 is pulled the lever 18 will move up turning on the wall switch 12 and when lower cord 88 is pulled the lever 18 will move down turning off the wall switch 12.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An extension control apparatus adapted to be mounted over a wall switch mounted within a wall, the wall switch having a moveable lever extending outwardly therefrom, said lever having an end, said apparatus comprising:

(a) a housing including a pair of side walls, an upper wall and a front wall having an aperture therein through which the lever of the wall switch extends, said housing also including an open bottom;

(b) a pair of upper and lower vertically aligned mounting screws for securing said housing to the wall over said wall switch;

(c) a pair of transverse guide posts, one of said guide posts is mounted fully within said housing parallel to said mounting screws and to one side of said mounting screws, while the other of said guide posts is mounted fully within said housing parallel and to an opposite side with respect to said one of said guide posts;

(d) a cap placed over said end of the lever said cap having a top and bottom; and (e) means connected to said cap and guided by said posts for selectively moving the lever upwardly and downwardly to operate the wall switch, wherein said means include a pair of spaced parallel cords wherein one of said cords is connected to a top of said cap around said upper mounting screws and an upper of said guide posts and downwardly therefrom through an open bottom of said housing while other of said cords is connected to a bottom of said cap around said lower mounting screw and a lower of said guide posts and downwardly therefrom through said open bottom of said housing.

* * * * *